US011162445B2

(12) United States Patent
Ishikawa et al.

(10) Patent No.: US 11,162,445 B2
(45) Date of Patent: Nov. 2, 2021

(54) VEHICLE

(71) Applicant: SUBARU CORPORATION, Tokyo (JP)

(72) Inventors: Yoichi Ishikawa, Tokyo (JP); Masaki Komuro, Tokyo (JP); Shuta Takeda, Tokyo (JP); Tetsu Matsuzaki, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 17/168,279

(22) Filed: Feb. 5, 2021

(65) Prior Publication Data

US 2021/0285393 A1 Sep. 16, 2021

(30) Foreign Application Priority Data

Mar. 10, 2020 (JP) ..... JP2020-040439

(51) Int. Cl.
*F02D 41/06* (2006.01)

(52) U.S. Cl.
CPC ..... *F02D 41/062* (2013.01); *F02D 2200/501* (2013.01); *F02D 2200/602* (2013.01)

(58) Field of Classification Search
CPC ..... F02D 41/062; F02D 2200/602; F02D 2200/501
See application file for complete search history.

(56) References Cited

U.S. PATENT DOCUMENTS

2009/0024292 A1* 1/2009 Kuwahara ..... F02D 11/105 701/70
2010/0197457 A1* 8/2010 Kuwahara ..... F02D 41/023 477/107
2016/0339780 A1* 11/2016 Yagi ..... B60K 26/02
2018/0202385 A1* 7/2018 Miwa ..... B60W 10/08

FOREIGN PATENT DOCUMENTS

JP 2018-115573 A 7/2018

* cited by examiner

*Primary Examiner* — Sizo B Vilakazi
(74) *Attorney, Agent, or Firm* — Troutman Pepper Hamilton Sanders LLP

(57) ABSTRACT

A vehicle includes an engine and an engine start controller. The engine start controller is configured to derive an integrated value while a target driving force derived on a basis of an accelerator operation amount is larger than or equal to a predetermined first threshold value from a time point when the target driving force becomes larger than or equal to the first threshold value, and to start the engine when the integrated value becomes larger than or equal to a predetermined second threshold value. The integrated value is obtained by integrating a difference value between the target driving force and the first threshold value.

11 Claims, 4 Drawing Sheets

VEHICLE

CROSS-REFERENCE TO RELATED APPLICATIONS

The present application claims priority from Japanese Patent Application No. 2020-040439 filed on Mar. 10, 2020, the entire contents of which are hereby incorporated by reference.

BACKGROUND

The disclosure relates to vehicles that include engines.

Japanese Unexamined Patent Application Publication No. 2018-115573 discloses a vehicle that includes an engine. The vehicle may stop the engine when a target driving force becomes smaller than a predetermined stoppage threshold value, and may start the engine when the target driving force becomes larger than or equal to a predetermined start threshold value.

SUMMARY

An aspect of the disclosure provides a vehicle including an engine and an engine start controller. The engine start controller is configured to derive an integrated value while a target driving force derived on a basis of an accelerator operation amount is larger than or equal to a predetermined first threshold value from a time point when the target driving force becomes larger than or equal to the first threshold value, and to start the engine when the integrated value becomes larger than or equal to a predetermined second threshold value. The integrated value is obtained by integrating a difference value between the target driving force and the first threshold value.

An aspect of the disclosure provides a vehicle including an engine and an engine start controller. The engine start controller is configured to derive an integrated value while target torque derived on a basis of an accelerator operation amount is larger than or equal to a predetermined first threshold value from a time point when the target torque becomes larger than or equal to the first threshold value, and to start the engine when the integrated value becomes larger than or equal to a predetermined second threshold value. The integrated value is obtained by integrating a difference value between the target torque and the first threshold value.

An aspect of the disclosure provides a vehicle including an engine and circuitry. The circuitry is configured to configured to derive an integrated value while a target driving force derived on a basis of an accelerator operation amount is larger than or equal to a predetermined first threshold value from a time point when the target driving force becomes larger than or equal to the first threshold value, and to start the engine when the integrated value becomes larger than or equal to a predetermined second threshold value. The integrated value is obtained by integrating a difference value between the target driving force and the first threshold value.

An aspect of the disclosure provides a vehicle including an engine and circuitry. The circuitry is configured to derive an integrated value while target torque derived on a basis of an accelerator operation amount is larger than or equal to a predetermined first threshold value from a time point when the target torque becomes larger than or equal to the first threshold value, and to start the engine when the integrated value becomes larger than or equal to a predetermined second threshold value. The integrated value is obtained by integrating a difference value between the target torque and the first threshold value.

BRIEF DESCRIPTION OF THE DRAWINGS

The accompanying drawings are included to provide a further understanding of the disclosure and are incorporated in and constitute a part of this specification. The drawings illustrate an embodiment and, together with the specification, serve to explain the principles of the disclosure.

DETAILED DESCRIPTION

When a vehicle is running, the driver may sometimes adjust the speed by pressing down on the accelerator pedal for a short period of time. In such a case, the target driving force may instantaneously become larger than or equal to a start threshold value, and the target driving force may then immediately decrease to become smaller than a stoppage threshold value. This results in a wasteful situation where the engine is repeatedly started and stopped within a short period of time, thus resulting in wasteful fuel consumption.

It is desirable to provide a vehicle that can improve fuel efficiency.

In the following, an embodiment of the disclosure is described in detail with reference to the accompanying drawings. Note that the following description is directed to an illustrative example of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following embodiment which are not recited in a most-generic independent claim of the disclosure are optional and may be provided on an as-needed basis. The drawings are schematic and are not intended to be drawn to scale. Throughout the present specification and the drawings, elements having substantially the same function and configuration are denoted with the same numerals to avoid any redundant description.

Figure 1:
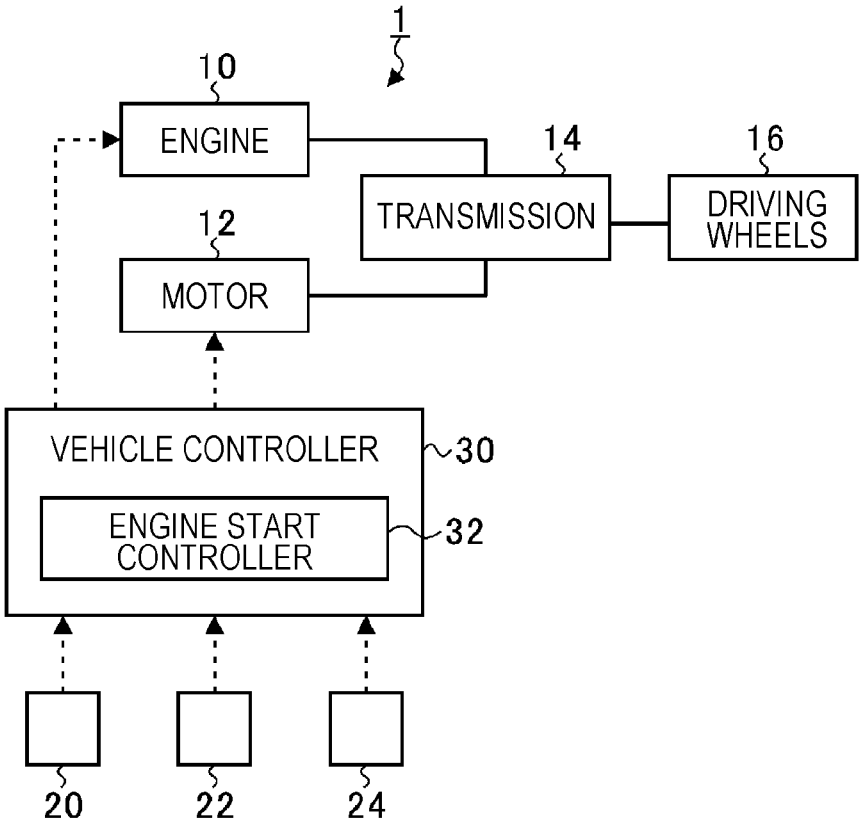
FIG. 1 schematically illustrates the configuration of a vehicle according to an embodiment.

FIG. 1 schematically illustrates the configuration of a vehicle 1 according to this embodiment. The vehicle 1 includes an engine 10, a motor 12, a transmission 14, driving wheels 16, an accelerator sensor 20, a brake sensor 22, a speed sensor 24, and a vehicle controller 30. The vehicle 1 is a hybrid electric automobile in which the engine 10 and the motor 12 are provided in tandem with each other.

The engine 10 causes pistons to move in a reciprocating motion by combusting fuel, such as gasoline.

The reciprocating motion of the pistons is converted into a rotational motion of a crankshaft via a connecting rod. The crankshaft is coupled to an output shaft of the engine 10. The output shaft of the engine 10 is coupled to the transmission 14.

The motor 12 is, for example, either one of a synchronous motor and an induction motor. A rotation shaft of the motor 12 is coupled to the transmission 14. The motor 12 consumes electric power supplied from a battery (not illustrated) via an inverter (not illustrated) so as to rotate the rotation shaft. Moreover, the motor 12 can also serve as an electric generator when the vehicle 1 is decelerating. Electric power generated by the motor 12 is regenerated to the battery via the inverter.

The transmission 14 is, for example, either one of a continuously variable transmission and a gear mechanism. The primary side of the transmission 14 is coupled to the output shaft of the engine 10 and to the rotation shaft of the motor 12. The secondary side of the transmission 14 is coupled to the driving wheels 16 with a differential gear (not illustrated) interposed therebetween. The driving wheels 16 are driven by a driving force transmitted from the engine 10 and the motor 12 via the transmission 14.

The accelerator sensor 20 detects an accelerator operation amount input via an accelerator pedal. The brake sensor 22 detects a brake operation amount input via a brake pedal. The speed sensor 24 detects, for example, the speed of the vehicle 1 based on the rotational speed of the driving wheels 16.

The vehicle controller 30 is constituted of a semiconductor integrated circuit including a central processing unit (CPU), a read-only memory (ROM) having a program stored therein, and a random access memory (RAM) used as a work area. The vehicle controller 30 executes a program so as to control the entire vehicle 1, such as driving, braking, and turning of the vehicle 1. This will be described in detail later. For example, the vehicle controller 30 derives a target driving force based on the detected accelerator operation amount and the detected brake operation amount. Then, the vehicle controller 30 controls the engine 10 and the motor 12 such that the actual driving force of the vehicle 1 becomes equal to the target driving force.

Furthermore, the vehicle controller 30 also serves as an engine start controller 32 by executing a program. The engine start controller 32 controls the startup and stoppage of the engine 10.

In detail, the engine start controller 32 stops the engine 10 when the target driving force is smaller than a predetermined stoppage threshold value in a state where the state-of-charge (SOC) of the battery is above or equal to a predetermined SOC. The stoppage threshold value is set to, for example, a value inversely proportional to the speed of the vehicle 1. When the engine 10 is stopped, the vehicle 1 is driven by the motor 12 alone.

The engine start controller 32 starts the engine 10 when a predetermined condition to be described below is satisfied in a state where the engine 10 is stopped. When the engine 10 is started, the vehicle 1 is driven by both the engine 10 and the motor 12. In a case where the SOC of the battery is below the predetermined SOC, the engine 10 may be started so that the vehicle 1 is driven by the engine 10 alone. The engine start controller 32 will be described in detail below.

Figure 2A:
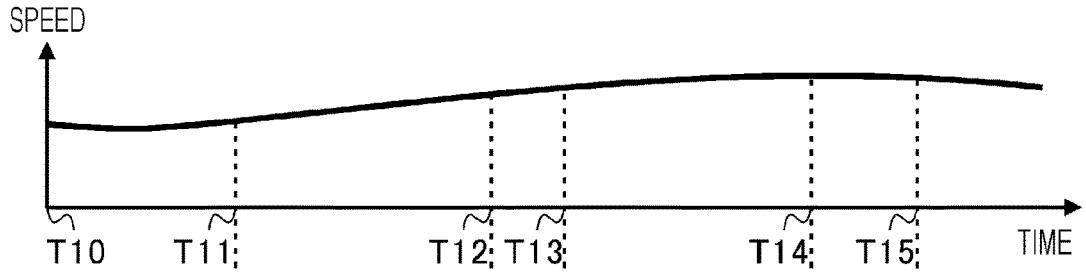
FIG. 2A to FIG. 2D illustrate an example of the operation of an engine start controller, FIG. 2A illustrating an example of temporal transition of the speed of the vehicle, FIG. 2B illustrating an example of temporal transition of an engine rotation speed, FIG. 2C illustrating an example of temporal transition of a target driving force, FIG. 2D illustrating an example of temporal transition of an integrated value.
Figure 2B:
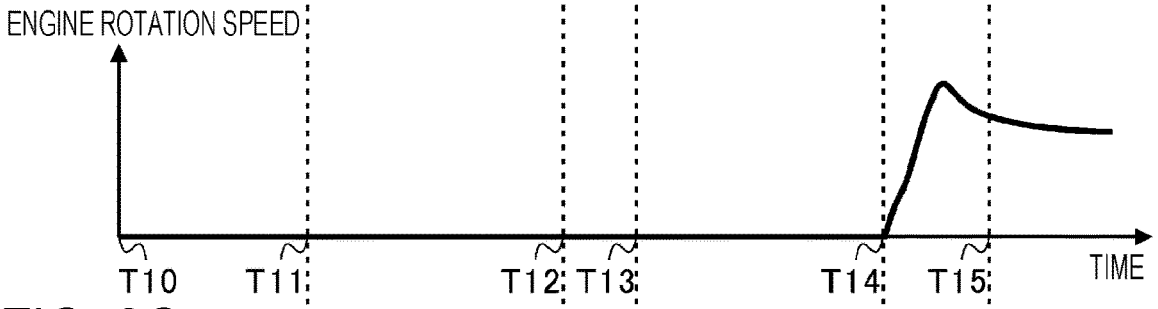
Figure 2C:
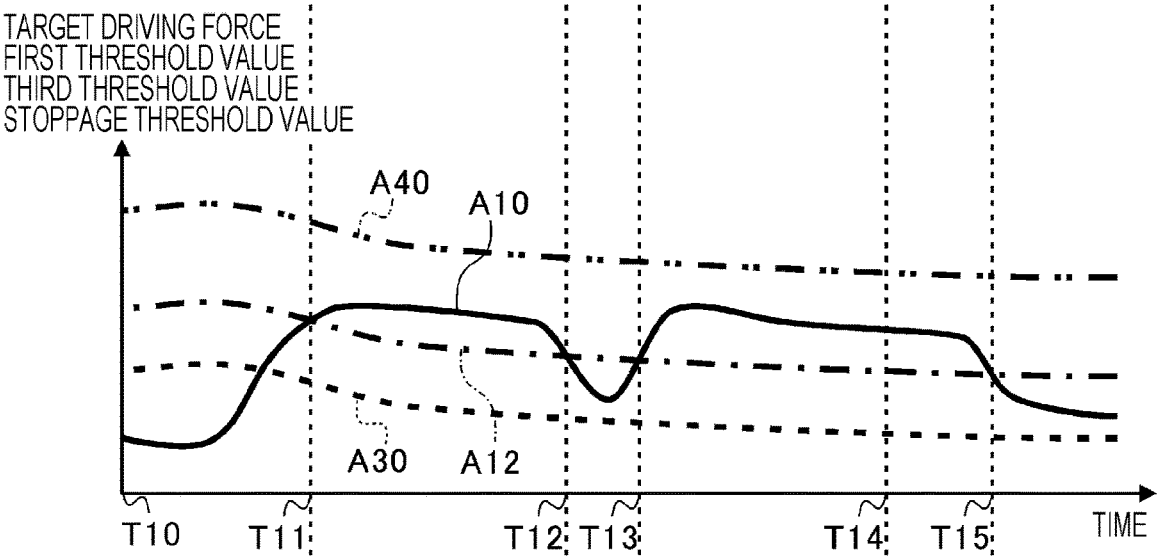
Figure 2D:
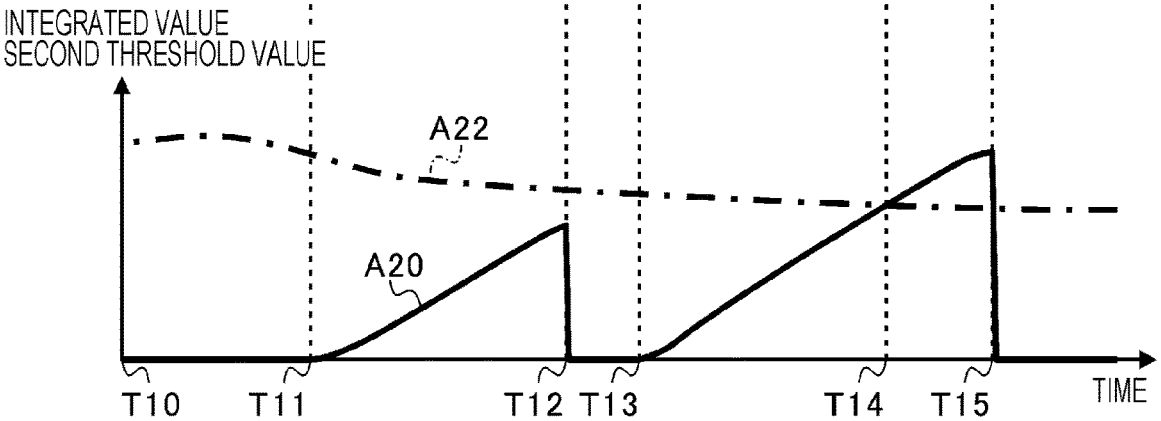

FIG. 2A to FIG. 2D illustrate an example of the operation of the engine start controller 32. FIG. 2A illustrates an example of temporal transition of the speed of the vehicle 1. FIG. 2B illustrates an example of temporal transition of the engine rotation speed. FIG. 2C illustrates an example of temporal transition of the target driving force. FIG. 2D illustrates an example of temporal transition of an integrated value. The integrated value will be described in detail later. The time axis is shared among FIG. 2A to FIG. 2D.

As illustrated in FIG. 2A and FIG. 2B, at a time point T10, the motor 12 alone is driven. Although the speed of the vehicle 1 is not zero, the engine 10 is stopped so that the engine rotation speed is zero. Moreover, at this time point T10, the target driving force indicated with a solid line A10 in FIG. 2C is smaller than a first threshold value indicated with a single-dot chain line A12 in FIG. 2C.

The first threshold value is derived based on the speed of the vehicle 1. In detail, the first threshold value is inversely proportional to the speed of the vehicle 1. In one example, the first threshold value changes in accordance with the current speed of the vehicle 1, such that the first threshold value is relatively large when the current speed of the vehicle 1 is low and is relatively small when the current speed of the vehicle 1 is high.

The engine start controller 32 determines whether the target driving force is larger than or equal to the first threshold value for every predetermined time period. As illustrated in FIG. 2C, it is assumed that the target driving force (solid line A10) changes to become larger than or equal to the first threshold value (single-dot chain line A12) at a time point T11 subsequent to the time point T10. With the target driving force becoming larger than or equal to the first threshold value, the engine start controller 32 starts to derive an integrated value indicated with a solid line A20 in FIG. 2D.

The integrated value is a value obtained by integrating a difference value between the target driving force and the first threshold value while the target driving force remains to be larger than or equal to the first threshold value from when the target driving force becomes larger than or equal to the first threshold value. For example, when the target driving force becomes larger than or equal to the first threshold value (e.g., at the time point T11), the previous integrated value is set as the initial value (e.g., zero). The engine start controller 32 first subtracts the current first threshold value from the current target driving force to derive the current difference value. The engine start controller 32 adds (integrates) the current difference value to the previous integrated value for every predetermined time period, so as to derive the current integrated value. Therefore, as indicated with the solid line A20 in FIG. 2D, the integrated value increases with time from the time point T11 and onward.

The engine start controller 32 determines whether the integrated value is larger than or equal to a second threshold value for every predetermined time period. Similar to the first threshold value, the second threshold value indicated with a single-dot chain line A22 in FIG. 2D is derived based on the speed of the vehicle 1. In detail, the second threshold value is inversely proportional to the speed of the vehicle 1.

As illustrated in FIG. 2C, it is assumed that the target driving force (solid line A10) changes to become smaller than the first threshold value (single-dot chain line A12) at a time point T12 subsequent to the time point T11. Furthermore, as illustrated in FIG. 2D, it is assumed that the integrated value (solid line A20) obtained as a result of integrating from the time point T11 to the time point T12 does not reach the second threshold value (single-dot chain line A22).

After starting the derivation of the integrated value, if the target driving force becomes smaller than the first threshold value, the engine start controller 32 resets the integrated value to the initial value (e.g., zero) even if the integrated value is not larger than or equal to the second threshold value. Consequently, as illustrated in FIG. 2D, the integrated value is reset to the initial value at the time point T12.

Accordingly, even when the target driving force is larger than or equal to the first threshold value, the engine 10 is not started if the integrated value is not larger than or equal to the second threshold value. Therefore, if the target driving force becomes larger than or equal to the first threshold value but immediately becomes smaller than the first threshold value, the engine 10 can be maintained in the stopped state, so that wasteful fuel consumption can be avoided.

As illustrated in FIG. 2C, it is assumed that the target driving force changes to become larger than or equal to the first threshold value at a time point T13 subsequent to the time point T12. Accordingly, as illustrated in FIG. 2D, the engine start controller 32 starts to derive the integrated value at the time point T13. In this case, since the integrated value is reset to the initial value at the time point T12, the integrated value increases with time from the initial value from the time point T13 and onward.

As illustrated in FIG. 2C, it is assumed that the target driving force is maintained to be larger than or equal to the first threshold value from the time point T13 to a time point T14 subsequent thereto. Then, as illustrated in FIG. 2D, it is assumed that the integrated value changes to become larger than or equal to the second threshold value at the time point T14.

The engine start controller 32 starts the engine 10 when the integrated value becomes larger than or equal to the second threshold value. Consequently, as illustrated in FIG. 2B, the engine rotation speed increases from the time point T14 and onward.

Accordingly, the vehicle 1 starts the engine 10 after waiting for the integrated value to become larger than or equal to the second threshold value, so that a situation where the engine 10 is started and stopped repeatedly within a short period of time can be suppressed.

As illustrated in FIG. 2C, it is assumed that the target driving force is maintained to be larger than or equal to the first threshold value from the time point T14 to a time point T15 subsequent thereto, and that the target driving force changes to become smaller than the first threshold value at the time point T15. As illustrated in FIG. 2D, even when the integrated value becomes larger than or equal to the second threshold value, the engine start controller 32 continues to derive the integrated value until the target driving force becomes smaller than the first threshold value. Then, as illustrated in FIG. 2D, the engine start controller 32 resets the integrated value to the initial value at the time point T15 at which the target driving force becomes smaller than the first threshold value.

Furthermore, as illustrated in FIG. 2C, the target driving force is maintained to be larger than or equal to a stoppage threshold value, indicated with a dashed line A30 in FIG. 2C, from the time point T15 and onward. Consequently, as illustrated in FIG. 2B, the engine 10 is maintained in a driven state from the time point T15 and onward. Accordingly, in the vehicle 1, a situation where the engine 10 is started and stopped repeatedly within a short period of time can be suppressed, while the engine 10 can be appropriately driven and started so long as the driver maintains the accelerator operation amount in an increased state to set the target driving force to be larger than or equal to the stoppage threshold value.

A two-dot chain line A40 in FIG. 2C indicates a third threshold value. The third threshold value is larger than the first threshold value. Similar to the first threshold value, the third threshold value is derived based on the speed of the vehicle 1. In detail, the third threshold value is inversely proportional to the speed of the vehicle 1. For example, the third threshold value is set to a value obtained by adding a predetermined value to the first threshold value.

In FIG. 2C, the target driving force is smaller than the third threshold value. That is, in the example in FIG. 2A to FIG. 2D, the target driving force does not become larger than or equal to the third threshold value. The following description relates to an example where the target driving force becomes larger than or equal to the third threshold value.

Figure 3A:
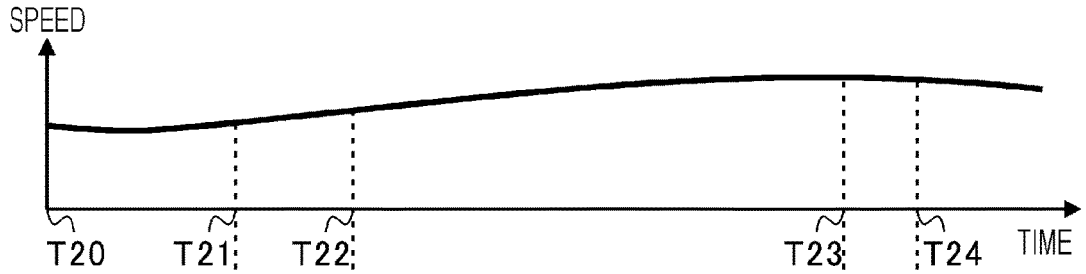
FIG. 3A to FIG. 3D illustrate another example of the operation of the engine start controller, FIG. 3A illustrating an example of temporal transition of the speed of the vehicle, FIG. 3B illustrating an example of temporal transition of the engine rotation speed, FIG. 3C illustrating an example of temporal transition of the target driving force, FIG. 3D illustrating an example of temporal transition of the integrated value.
Figure 3B:
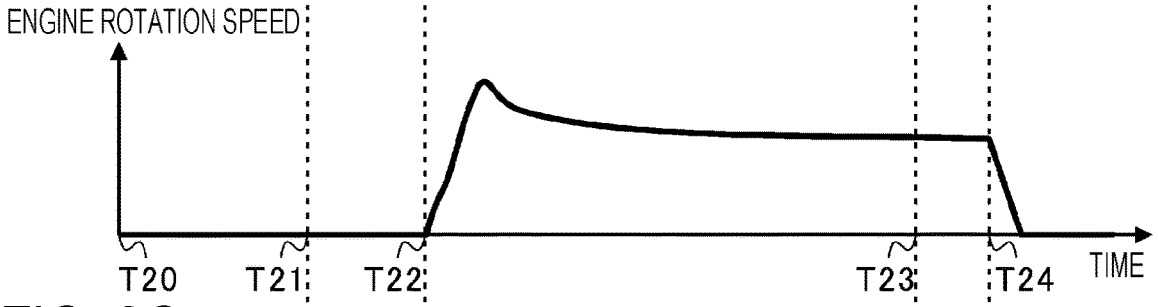
Figure 3C:
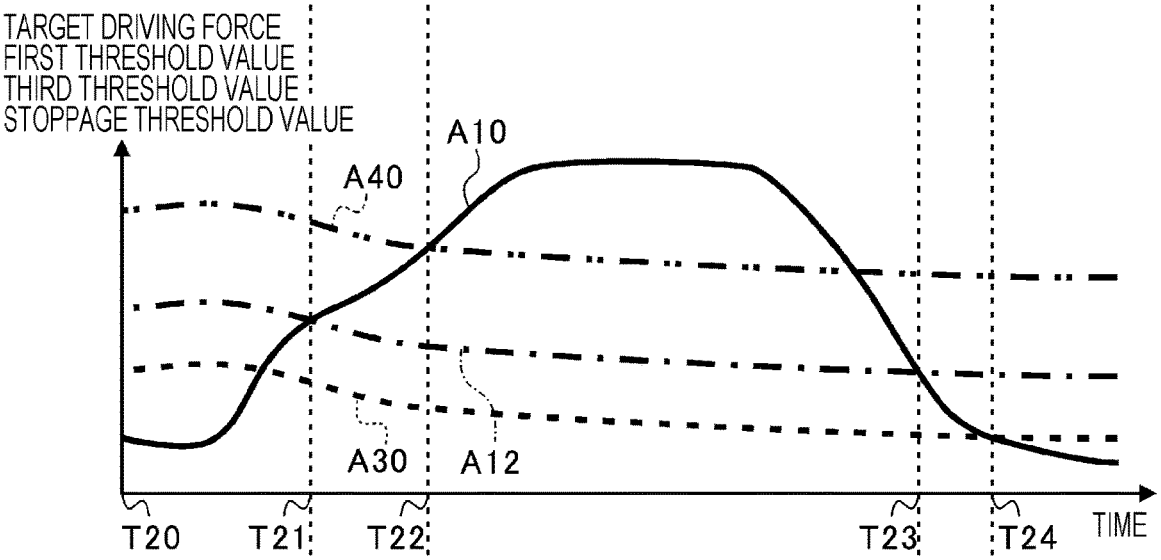
Figure 3D:
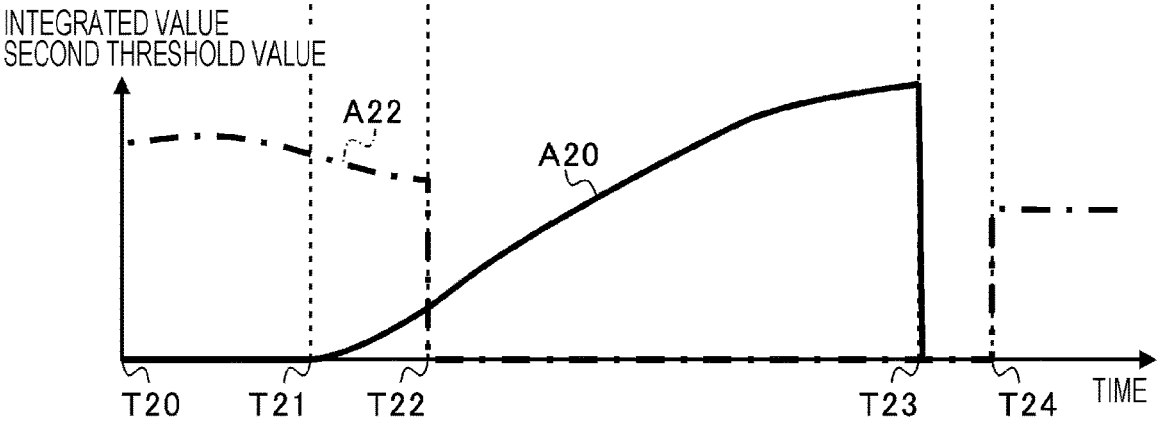

FIG. 3A to FIG. 3D illustrate another example of the operation of the engine start controller 32. FIG. 3A illustrates an example of temporal transition of the speed of the vehicle 1. FIG. 3B illustrates an example of temporal transition of the engine rotation speed. FIG. 3C illustrates an example of temporal transition of the target driving force. FIG. 3D illustrates an example of temporal transition of the integrated value. The time axis is shared among FIG. 3A to FIG. 3D.

As illustrated in FIG. 3A and FIG. 3B, at a time point T20, the motor 12 alone is driven. Although the speed of the vehicle 1 is not zero, the engine 10 is stopped so that the engine rotation speed is zero. Moreover, at this time point T20, the target driving force (solid line A10) is smaller than the first threshold value (single-dot chain line A12), as illustrated in FIG. 3C. As illustrated in FIG. 3C, it is assumed that the target driving force changes to become larger than or equal to the first threshold value at a time point T21 subsequent to the time point T20. With the target driving force becoming larger than or equal to the first threshold value, the engine start controller 32 starts to derive an integrated value (solid line A20), as illustrated in FIG. 3D. Accordingly, the integrated value increases with time from the time point T21 and onward.

It is assumed that the integrated value is smaller than the second threshold value from the time point T21 to a time point T22 subsequent thereto. As illustrated in FIG. 3C, it is assumed that the target driving force changes to become larger than or equal to the third threshold value (two-dot chain line A40) at the time point T22.

The engine start controller 32 determines whether the target driving force is larger than or equal to the third threshold value for every predetermined time period. When the target driving force is larger than or equal to the third threshold value, the engine start controller 32 forcibly decreases the second threshold value, as illustrated in FIG. 3D. In the example in FIG. 3D, the second threshold value is forcibly decreased to zero. As a result, the integrated value is definitely larger than or equal to the second threshold value regardless of the integrated value at that point, so that the engine start controller 32 starts the engine 10. Consequently, as illustrated in FIG. 3B, the engine rotation speed increases from the time point T22 and onward.

Accordingly, in the vehicle 1, the engine 10 can be quickly started when the driver desires to quickly increase the driving force.

In the above example, the second threshold value is forcibly decreased to zero when the target driving force becomes larger than or equal to the third threshold value. However, the specific value to be used after decreasing the second threshold value is not limited to zero, and may be any value so long as the engine 10 can be started by comparing the value with the integrated value.

As illustrated in FIG. 3C, it is assumed that the target driving force changes to become smaller than the first threshold value at a time point T23 subsequent to the time point T22. With the target driving force becoming smaller than the first threshold value, the engine start controller 32 resets the integrated value to the initial value (e.g., zero), as illustrated in FIG. 3D.

As illustrated in FIG. 3C, it is assumed that the target driving force becomes smaller than the stoppage threshold value at a time point T24 subsequent to the time point T23. When the target driving force is smaller than the stoppage threshold value, the engine start controller 32 stops the engine 10. Consequently, as illustrated in FIG. 3B, the engine rotation speed decreases to zero from the time point T24 and onward.

Furthermore, when the target driving force becomes smaller than the stoppage threshold value, the engine start controller 32 cancels the value of zero set as the second threshold value and resets the second threshold value to a value based on the speed of the vehicle 1. Consequently, even when the derivation of the integrated value is started in response to the target driving force becoming larger than or equal to the first threshold value from the time point T24 and onward, the start timing of the engine 10 can be appropriately determined.

In the above example, the second threshold value is reset when the engine 10 is to be stopped. However, the timing for resetting the second threshold value is not limited to this example. For example, the second threshold value may be reset when the integrated value is reset to the initial value.

As illustrated in FIG. 3A to FIG. 3D, when the target driving force drastically exceeds the first threshold value and becomes larger than or equal to the third threshold value, the engine start controller 32 starts the engine 10 without waiting for the integrated value to become larger than or equal to the second threshold value derived based on the speed of the vehicle 1. Therefore, in the vehicle 1, the engine 10 is quickly started when the driver presses down on the accelerator pedal by a large amount, so that degradation of an acceleration response can be suppressed.

Figure 4:
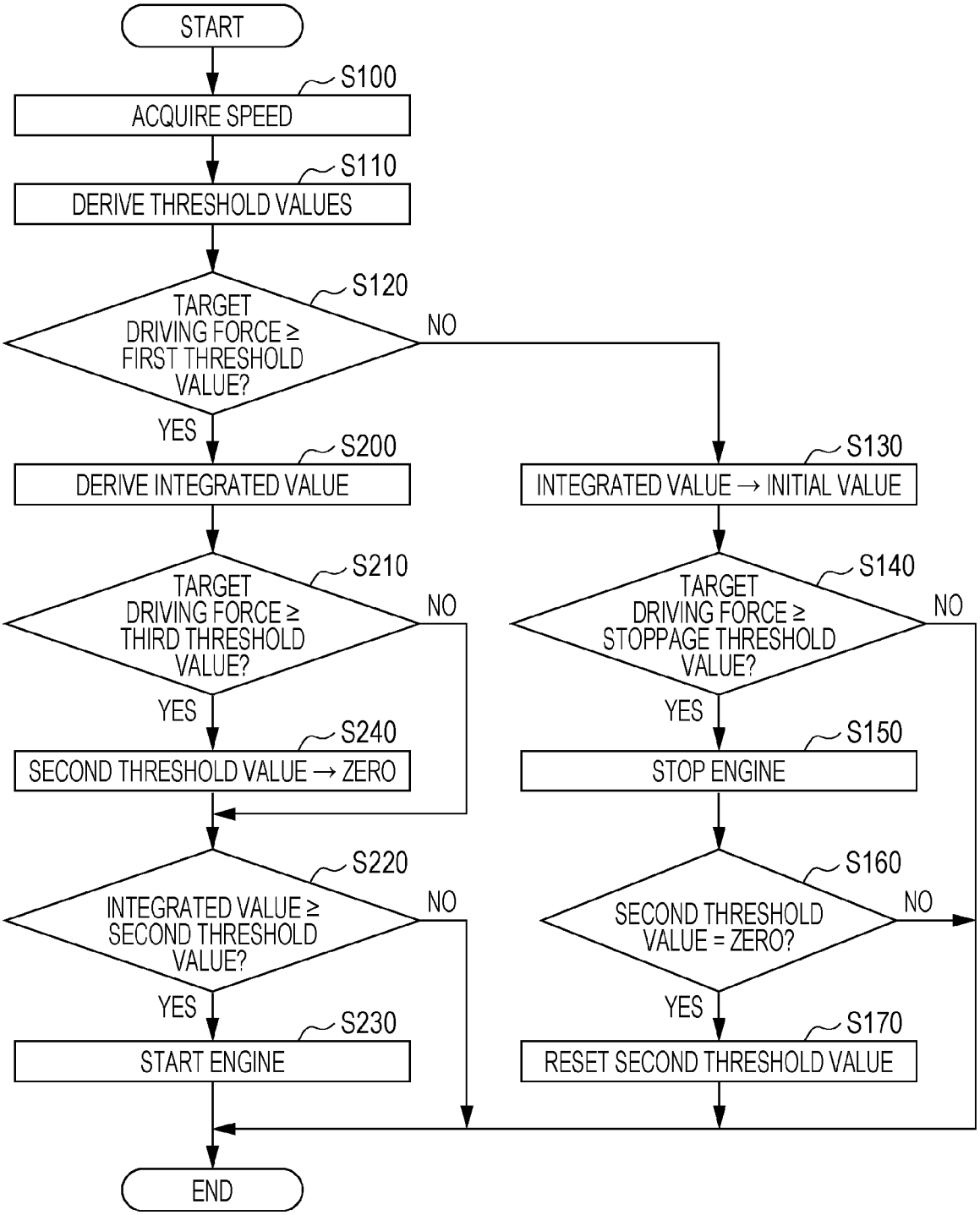
FIG. 4 is a flowchart illustrating the flow of the operation of the engine start controller.

FIG. 4 is a flowchart illustrating the flow of the operation of the engine start controller 32. The engine start controller 32 repeats the process in FIG. 4 at every interruption timing occurring at a predetermined control cycle.

First, in step S100, the engine start controller 32 acquires the speed of the vehicle 1 from the speed sensor 24. Then, in step S110, the engine start controller 32 derives the various threshold values (i.e., the first threshold value, the second threshold value, the third threshold value, and the stoppage threshold value) based on the speed of the vehicle 1. For example, the engine start controller 32 derives each of the first threshold value, the second threshold value, and the stoppage threshold value that are inversely proportional to the speed of the vehicle 1. The engine start controller 32 derives the third threshold value by adding a predetermined value to the first threshold value.

Subsequently, in step S120, the engine start controller 32 determines whether the current target driving force is larger than or equal to the current first threshold value. If the current target driving force is not larger than or equal to the current first threshold value (i.e., is smaller than the first threshold value) (NO in step S120), the engine start controller 32 sets the integrated value to the initial value (i.e., zero) in step S130.

Then, in step S140, the engine start controller 32 determines whether the current target driving force is smaller than the current stoppage threshold value. If the current target driving force is smaller than the current stoppage threshold value (i.e., is larger than or equal to the stoppage threshold value) (NO in step S140), the engine start controller 32 ends the process. In this case, the engine 10 is maintained in a driven state if the engine 10 is being driven, or is maintained in a stopped state if the engine 10 is being stopped.

If the current target driving force is smaller than the current stoppage threshold value (YES in step S140), the engine start controller 32 stops the engine 10 in step S150. In this case, the engine 10 being driven is stopped. If the engine 10 is already in a stopped state, the engine 10 is continuously maintained in the stopped state.

Subsequently, in step S160, the engine start controller 32 determines whether the second threshold value is zero. If the second threshold value is not zero (NO in step S160), the engine start controller 32 ends the process. In this case, the second threshold value is derived based on the speed of the vehicle 1.

If the second threshold value is zero (YES in step S160), the engine start controller 32 resets the second threshold value in step S170 and ends the process. Accordingly, the second threshold value is derived based on the speed of the vehicle 1 thereafter.

If the target driving force is larger than or equal to the first threshold value in step S120 (YES in step S120), the engine start controller 32 derives the integrated value in step S200. In detail, the engine start controller 32 subtracts the current first threshold value from the current target driving force so as to derive the current difference value. Then, the engine start controller 32 adds the current difference value to the previous integrated value so as to update the integrated value.

Then, in step S210, the engine start controller 32 determines whether the current target driving force is larger than or equal to the current third threshold value. If the current target driving force is not larger than or equal to the current third threshold value (i.e., is smaller than the third threshold value) (NO in step S210), the engine start controller 32 determines in step S220 whether the current integrated value is larger than or equal to the current second threshold value.

If the current integrated value is not larger than or equal to the current second threshold value (i.e., is smaller than the second threshold value) (NO in step S220), the engine start controller 32 ends the process. In this case, the engine 10 in the stopped state is not started.

If the current integrated value is larger than or equal to the current second threshold value (YES in step S220), the engine start controller 32 starts the engine 10 in step S230 and ends the process. If the engine 10 is already in a driven state, the engine 10 is continuously maintained in the driven state.

If the current target driving force is larger than or equal to the current third threshold value in step S210 (YES in step S210), the engine start controller 32 sets the current second threshold value to zero in step S240 and proceeds to step S220. From hereafter, the second threshold value is set to zero until it is reset in step S170 described above.

If the process proceeds to step S220 via step S240, the current second threshold value is set to zero. Thus, the current integrated value is larger than or equal to the current second threshold value (YES in step S220), and the engine start controller 32 starts the engine 10 in step S230. That is, the engine 10 is started when the current target driving force becomes larger than or equal to the current third threshold value.

Accordingly, the engine start controller 32 of the vehicle 1 according to this embodiment derives an integrated value when the target driving force becomes larger than or equal to the first threshold value, and starts the engine 10 when the integrated value becomes larger than or equal to the second threshold value. That is, in the vehicle 1 according to this embodiment, even when the target driving force is larger than or equal to the first threshold value, the engine 10 is not started until the integrated value becomes larger than or equal to the second threshold value. Therefore, in the vehicle 1 according to this embodiment, if the target driving force becomes smaller than the first threshold value immediately after the target driving force becomes larger than or equal to the first threshold value, the engine 10 can be continuously maintained in a stopped state.

Consequently, the vehicle 1 according to this embodiment can prevent a wasteful situation where the engine 10 is repeatedly started and stopped within a short period of time, thereby achieving improved fuel efficiency. Furthermore, in the vehicle 1 according to this embodiment, the engine 10 can be appropriately started when the integrated value reaches the second threshold value.

Moreover, the engine start controller 32 of the vehicle 1 according to this embodiment starts to derive an integrated value and subsequently resets the integrated value to the initial value if the target driving force is smaller than the first threshold value. Therefore, in the vehicle 1 according to this embodiment, the integrated value can be increased from the initial value every time the derivation of the integrated value is commenced, so that the comparison between the integrated value and the second threshold value can be appropriately performed.

Furthermore, when the target driving force is larger than or equal to the third threshold value, the engine start controller 32 of the vehicle 1 according to this embodiment decreases the second threshold value relative to the second threshold value used when the target driving force is less than the third threshold value. As a result, the integrated value becomes larger than or equal to the second threshold value, so that the engine 10 is started. Thus, in the vehicle 1 according to this embodiment, for example, the engine 10 is immediately started when the accelerator pedal is pressed by a large amount, so that degradation of an acceleration response can be suppressed.

Moreover, the first threshold value, the second threshold value, and the third threshold value in the vehicle 1 according to this embodiment are set based on the speed of the vehicle 1. When the engine 10 is stopped, the vehicle 1 is driven by the motor 12 alone. The driving force of the motor 12 decreases as the rotation speed of the motor 12, that is, the speed of the vehicle 1, increases. Therefore, with the first threshold value, the second threshold value, and the third threshold value being set based on the speed of the vehicle 1, the driving force characteristics of the motor 12 are reflected on the start timing of the engine 10. As a result, in the vehicle 1 according to this embodiment, reduced efficiency of the motor 12 can be suppressed.

Although the embodiment of the disclosure has been described above with reference to the appended drawings, the disclosure is not limited to the above embodiment. It is apparent to a person skilled in the art that various modifications and alterations are conceivable within the scope defined in the claims, and it is to be understood that such modifications and alterations naturally belong to the technical scope of the disclosure.

For example, in the above embodiment, the first threshold value, the second threshold value, the third threshold value, and the stoppage threshold value are set based on the speed of the vehicle 1. Instead of being set based on the speed of the vehicle 1, the first threshold value, the second threshold value, the third threshold value, and the stoppage threshold value may be set to, for example, predetermined constants (i.e., fixed values). For example, either one of the first threshold value and the second threshold value may be set based on the speed of the vehicle 1, and the other may be set to a fixed value.

Furthermore, in the above embodiment, the engine 10 is started in a state where the vehicle 1 is running with the driving force of the motor 12 alone (i.e., a state where the speed of the vehicle 1 is larger than zero).

Alternatively, the above-described control of the start timing of the engine 10 may be applied when the vehicle 1 starts running from a stopped state (i.e., when the speed of the vehicle 1 is zero).

In the above embodiment, it is determined whether to start or stop the engine 10 by using the target driving force. Alternatively, since target torque can be derived by multiplying the target driving force by the radius of the driving wheels 16 (i.e., tires), it may be determined whether to start or stop the engine 10 by using the target torque in place of the target driving force. In this case, the first threshold value, the second threshold value, the third threshold value, and the stoppage threshold value are set as dimensions of torque.

The vehicle controller 30 illustrated in FIG. 1 can be implemented by circuitry including at least one semiconductor integrated circuit such as at least one processor (e.g., a central processing unit (CPU)), at least one application specific integrated circuit (ASIC), and/or at least one field programmable gate array (FPGA). At least one processor can be configured, by reading instructions from at least one machine readable tangible medium, to perform all or a part of functions of the vehicle controller 30 including the engine start controller 32. Such a medium may take many forms, including, but not limited to, any type of magnetic medium such as a hard disk, any type of optical medium such as a CD and a DVD, any type of semiconductor memory (i.e., semiconductor circuit) such as a volatile memory and a non-volatile memory. The volatile memory may include a DRAM and a SRAM, and the non-volatile memory may include a ROM and a NVRAM. The ASIC is an integrated circuit (IC) customized to perform, and the FPGA is an integrated circuit designed to be configured after manufacturing in order to perform, all or a part of the functions of the modules illustrated in FIG. 1.

The invention claimed is:

1. A vehicle comprising:

an engine; and an engine start controller configured to derive an integrated value while a target driving force derived on a basis of an accelerator operation amount is larger than or equal to a predetermined first threshold value from a time point when the target driving force becomes larger than or equal to the first threshold value, and to start the engine when the integrated value becomes larger than or equal to a predetermined second threshold value, the integrated value being obtained by integrating a difference value between the target driving force and the first threshold value.

2. The vehicle according to claim 1, wherein, in a case that the target driving force becomes smaller than the first threshold value after the engine start controller starts to derive the integrated value, the engine start controller is configured to reset the integrated value to an initial value.

3. The vehicle according to claim 1, wherein one of or each of the first threshold value and the second threshold value is set on a basis of a speed of the vehicle.

4. The vehicle according to claim 2, wherein one of or each of the first threshold value and the second threshold value is set on a basis of a speed of the vehicle.

5. The vehicle according to claim 1, wherein, in a case that the target driving force becomes larger than or equal to a predetermined third threshold value that is larger than the first threshold value, the engine start controller is configured to decrease the second threshold value relative to the second threshold value used when the target driving force is smaller than the third threshold value.

6. The vehicle according to claim 2, wherein, in a case that the target driving force becomes larger than or equal to a predetermined third threshold value that is larger than the first threshold value, the engine start controller is configured to decrease the second threshold value relative to the second threshold value used when the target driving force is smaller than the third threshold value.

7. The vehicle according to claim 3, wherein, in a case that the target driving force becomes larger than or equal to a predetermined third threshold value that is larger than the first threshold value, the engine start controller is configured to decrease the second threshold value relative to the second threshold value used when the target driving force is smaller than the third threshold value.

8. The vehicle according to claim 4, wherein, in a case that the target driving force becomes larger than or equal to a predetermined third threshold value that is larger than the first threshold value, the engine start controller is configured to decrease the second threshold value relative to the second threshold value used when the target driving force is smaller than the third threshold value.

9. A vehicle comprising:

an engine; and an engine start controller configured to derive an integrated value while target torque derived on a basis of an accelerator operation amount is larger than or equal to a predetermined first threshold value from a time point when the target torque becomes larger than or equal to the first threshold value, and to start the engine when the integrated value becomes larger than or equal to a predetermined second threshold value, the integrated value being obtained by integrating a difference value between the target torque and the first threshold value.

10. A vehicle comprising:

an engine; and circuitry configured to derive an integrated value while a target driving force derived on a basis of an accelerator operation amount is larger than or equal to a predetermined first threshold value from a time point when the target driving force becomes larger than or equal to the first threshold value, the integrated value being obtained by integrating a difference value between the target driving force and the first threshold value, and start the engine when the integrated value becomes larger than or equal to a predetermined second threshold value.

11. A vehicle comprising:

an engine; and circuitry configured to derive an integrated value while target torque derived on a basis of an accelerator operation amount is larger than or equal to a predetermined first threshold value from a time point when the target torque becomes larger than or equal to the first threshold value, the integrated value being obtained by integrating a difference value between the target torque and the first threshold value, and start the engine when the integrated value becomes larger than or equal to a predetermined second threshold value.

* * * * *